United States Patent [19]

Chadwick et al.

[11] 4,177,085

[45] Dec. 4, 1979

[54] METHOD FOR SOLUTION HEAT TREATMENT OF 6201 ALUMINUM ALLOY

[75] Inventors: Kenneth E. Chadwick; E. Henry Chia; Frank M. Powers, all of Carrollton, Ga.

[73] Assignee: Southwire Company, Carrollton, Ga.

[21] Appl. No.: 841,275

[22] Filed: Oct. 12, 1977

Related U.S. Application Data

[63] Continuation-in-part of Ser. No. 681,925, Apr. 30, 1976, abandoned.

[51] Int. Cl.[2] ..... C22F 1/04

[52] U.S. Cl. ..... 148/2; 148/11.5 A

[58] Field of Search ..... 148/2, 3, 11.5 A, 12.7 A, 148/32, 32.5

[56] References Cited

U.S. PATENT DOCUMENTS

| | | | |
|---|---|---|---|
| 3,418,177 | 12/1968 | Pryor | 148/11.5 A |
| 3,613,767 | 10/1971 | Cofer | 164/76 |
| 3,791,876 | 2/1974 | Kroger | 148/2 |

*Primary Examiner*—L. Dewayne Rutledge
*Assistant Examiner*—Peter K. Skiff
*Attorney, Agent, or Firm*—Herbert M. Hanegan; Stanley L. Tate; Robert S. Linne

[57] ABSTRACT

An improved method of continuously manufacturing a hot-formed, heat treatable aluminum base alloy product comprising casting a molten aluminum base alloy metal, cooling a cast metal during casting at a rate at which solidification shrinkage will not occur, hot-forming cast metal to form a rod at a temperature above the temperature level at which the alloy metals will precipitate to the grain boundaries of the aluminum base metal, heating the rod to a solutionizing temperature after hot forming and subsequently reducing the metal temperature from the solutionizing temperature of the metal to a temperature at which no substantial immediate precipitation occurs within a time interval before which any substantial precipitation occurs.

16 Claims, 2 Drawing Figures

METHOD FOR SOLUTION HEAT TREATMENT OF 6201 ALUMINUM ALLOY

CROSS-REFERENCE TO RELATED APPLICATIONS

This application is a continuation-in-part of co-pending application Ser. No. 681,925, abandoned, filed Apr. 30, 1976.

BACKGROUND OF THE INVENTION 6201 aluminum alloy is a high strength aluminum-magnesium-silicon alloy which in wire form and in the heat treated condition has a tensile strength of over 46,000 PSI, elongation greater than three percent, and electrical conductivity greater than 52.5% IACS. In the past, 6201 aluminum alloy redraw rod and similar aluminum alloy redraw rods have been manufactured for commercial use by a plurality of separate steps which include: DC casting, and continuously casting and rolling rod above solutionizing temperature of the metal. When 6201 alloy rod is produced by the DC casting method an aluminum ingot is reheated to temperatures of from about 700 to about 850° F., the reheated cast ingot is then hot rolled to form redraw rod and solutionized at a temperature of approximately 1,000° F. after which the redraw rod is quenched with water. The rod is then cold drawn to form wire, and the wire is artificially aged at temperatures between 250° F. and 450° F. While the foregoing procedure produced acceptable product, such a batch process when not continuously cast processed was capable of producing only a limited amount of rod; that is, a given size billet would produce only a corresponding mass of rod, and the lengths of separately produced rod would be required to be welded together to form longer lengths of rod. When the billet was reheated to form rod, it was customary to crop the leading end of the rod since it was of an inferior quality. Thus a substantial amount of waste was produced using this procedure. Further, an elongated rod which comprised several lengths of batch produced product welded together would include poor grain structure at the places where it was welded together which affected the tensile strength and the conductivity of the rod. Furthermore, it was virtually impossible to create identical conditions in the reheating and rolling of different billets and the lengths of rod welded together would usually have different grain characteristics.

The prior art batch process provides a substantial amount of time in which the aluminum can oxidize, as when the cast ingot cools, or is being reheated, when the rod from the rolling mill cools or is being reheated for solutionizing, and when the solutionized rod from the reheating oven cools. The result is that the rod becomes substantially oxidized, which makes it relatively hard for redrawing purposes, and which causes the rod have a relatively dull finish. Further, a highly oxidized and hard rod is more difficult to draw and the dies used for drawing deteriorate rapidly. Thus, the separate steps required in the prior art batch process for forming 6201 aluminum alloy rod are expensive in that separate handling of the rod is required between and during each step, the product must be handled in careful manner, and extra equipment must be available and maintained to handle the product.

An improved method for continuously casting and rolling 6201 aluminum alloy rod was described in U.S. Pat. No. 3,613,767. Briefly described, the invention of U.S. Pat. No. 3,613,767 comprises a method of continuously manufacturing aluminum base alloy rod, such as 6201 aluminum alloy rod, without the necessity of reheating the ingot of the rod during the process. The bar emerged from the continuous casting machine and was passed through a rolling mill, a quench tube and then cooled in a continuous process. The heat of the cast bar emerging from the continuous casting machine does not dissipate and the bar temperature is maintained in the solutionizing temperature range of the metal as the rod was passed to the rolling mill. The rod was hot worked in the rolling mill and quenched immediately as it emerged from the rolling mill so that the time lapse from a point where the bar entered the rolling mill to where the rod was quenched to a temperature level below the crystallization temperature of the alloy metals was less than the time acquired for the alloy metals to precipitate to the grain boundaries of the metal. After the rod was quenched it was at a temperature below the temperature where immediate and substantial precipitation would occur. When the rod was subsequently cold drawn into wire it had unusually high tensile strength and a relatively high electrical conductivity and an unusually bright appearance. Thus the major problems of separate handling between each of the steps in the prior art process were eliminated by the practice of the invention disclosed in U.S. Pat. No. 3,613,767. However, the solution to the problems inherent in the prior art batch process while preparing 6201 aluminum alloy resulted in an aluminum alloy rod, which due to the heat loss during the continuous casting and rolling, had large precipitates on the order of 20,000 angstrom units in size formed therein because of the relatively high temperature at which precipitation occured. Therefore this solution to the problems caused by batch processing of 6201 aluminum alloy created an entirely new set of problems. In column 5, beginning at line 38 of U.S Pat. No. 3,613,767 the following statement is found:

> "It has been found that the temperature and other conditions in the process can be varied within reasonable limits without detriment to the characteristics of the product. For instance, the temperature of the molten metal in the pouring pot and the metal bar extracted from the casting wheel appear to have no effect on the quality of 6201 alloy rod as long as the temperature is not lowered below the solutionizing temperature."

While this statement may be true with respect to the alloy properties of 6201 it is incorrect with respect to the properties of the cast bar and the rod rolled from the cast bar. U.S. Pat. No. 3,613,767 describes a method of continuously casting 6201 aluminum alloy which requires the cast bar to exit the casting wheel at a temperature above the solutionizing temperature and remain above this temperature until the cast bar enters the rolling mill for hot working and quenching subsequently occur. In order to meet this requirement, the cast bar of U.S. Pat. No. 3,613,767 must exit the casting wheel at a temperature substantially above the solutionizing temperature of the alloy. To remove the cast bar from the casting wheel at temperatures taught by U.S. Pat. No. 3,613,767 the bar must be cooled in such a way that the bar does not become totally solid until it reaches a point in the casting wheel that molten metal cannot flow into, and fill voids created in the bar by the shrinkage of the metal in the casting mold during solidification. If such voids are created in the exterior portions of the cast bar, oxidation will occur within the void and when the bar is rolled outside inclusions will be trapped within the resulting rod causing the rod to become brittle at the points where the outside inclusions occur thereby significantly decreasing the draw-ability of rod. If solidification shrinkage voids occur in the interior of the rod where oxidation cannot occur such voids will cause internal microcracking which significantly affects the elongation of the rod thereby directly affecting the post-coldworking characteristics of the rod. It has also been found that the solutionizing temperature of 6201 aluminum alloy varies according to the concentration of other elements present within the alloy in that the higher the concentration of alloying elements present the lower the solutionizing temperature of the alloy. Therefore given the range of concentration acceptable within 6201 alloy the solutionizing temperature may vary from about 850° F. to about 1140° F. Accordingly, U.S. Pat. No. 3,613,767 does not provide an acceptable method for continuously producing 6201 alloy rod having the alloying element concentrations in the range which causes the alloy to solutionize at temperatures in the upper portion of 6201 aluminum alloy solutionizing temperature range. Accordingly, there still remain significant improvements to be made in the process for continuously casting heat-treatable aluminum alloy rod from aluminum alloys in 6201.

For the purpose of clarity, heat treatable aluminum alloys as used in this specification shall mean those aluminum alloys which contain alloying elements which have a high solid solubility in aluminum at high temperatures and a low solid solubility in aluminum when cooled to room temperature. These alloys harden by precipitation of a second phase during heat treatment and the alloying elements are kept in solution by rapid quenching from high temperatures.

For the purpose of clarity, wrought aluminum alloys as used in this specification shall mean those aluminum alloys which contain alloying elements which have low solid solubility in aluminum at high temperatures as well as low temperatures. These alloys normally harden by work hardening which is a hardening mechanism which operates during cold working of the alloy.

DESCRIPTION OF THE PREFERRED EMBODIMENT

Figure 1:
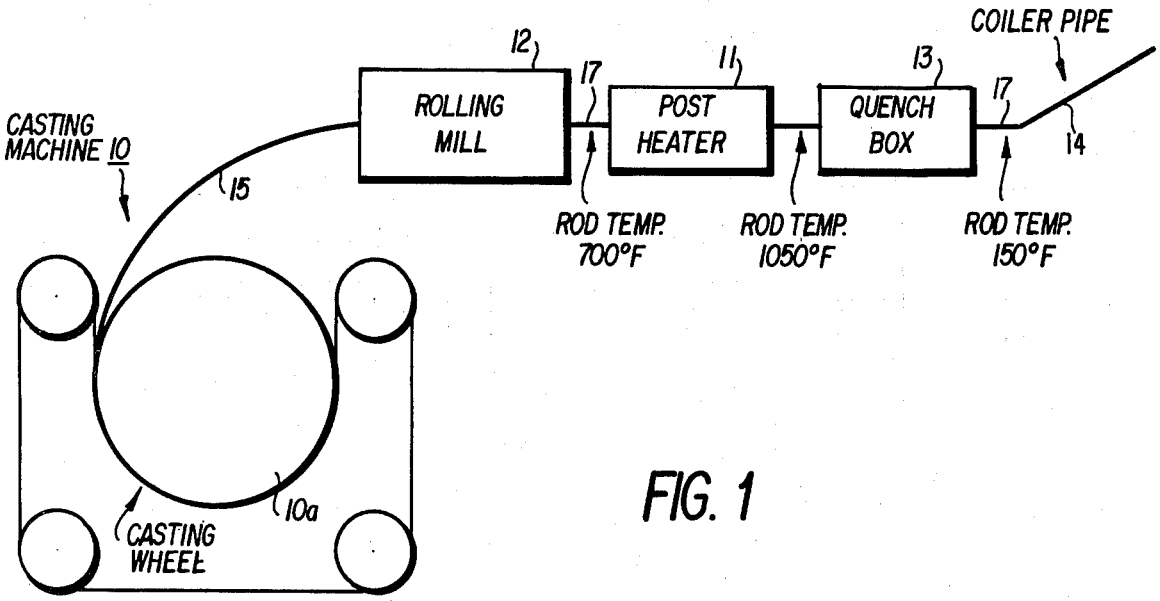
FIG. 1 is a schematic side elevational view of a casting machine, rolling mill, quenching tube and coiler utilized in the procedure herein set forth.

Referring now to the drawings, in which like numerals indicate like parts throughout the several views, FIG. 1 shows a casting machine 10, a heater 11, a rolling mill 12, a quench assembly 13 and a coiler pipe 14. The process of the present invention comprises pouring molten metal from a furnace (not shown) into a casting wheel 10*a* of casting machine 10. Molten metal is cooled and solidified in the casting wheel 10*a* and extracted as a solid bar. Bar 15 is then continuously guided toward and through rolling mill 12 wherein the bar is lengthened and reduced in its cross sectional area and emerges from rolling mill 12 as a wrought rod 17 at a temperature of about 700° F. Rod 17 is then continuously passed through heater 11 wherein the temperature of rod 17 is raised to about 1050° F. After passing through heater 11, rod 17 having been heated to a temperature from about 800° F. to about 1050° F. enters quench assembly 13 wherein the temperature of the rod is rapidly lowered to a temperature below about 400° F., generally to about 150° F. after which rod 17 enters coiler pipe 14 for coiling by means of a continuous coiling apparatus (not shown). In more detail, the product produced in the practice of the present invention is a heat treatable aluminum alloy 6201. Metallurgical composition of the aluminum alloy 6201 is generally accepted to be as follows: silicon and magnesium are present in concentrations of from about 0.50 to about 0.90 weight percent, and from about 0.60 to about 0.90 weight percent, respectively. The range of silicon and magnesium present in alloys processed for the method of this invention can be varied beyond the concentration ranges for alloying elements in 6201 alloy, to from about 0.20 to about 1.30 weight percent and from 0.30 to about 1.40 weight percent, respectively, if desired.

Metal in its molten state is poured through a fiberglass screen into a holding pot maintained at a temperature above 1200° F. usually at about 1270° F. From a holding pot, the metal is poured in casting wheel 10*a* of casting machine 10 where it is cooled to a temperature from 800° F. to about 940° F. and solidified into cast bar at a rate which solidification shrinkage will not occur generally at a rate of from about 24° F. per second when casting a 3.3 square inch bar at a rate of 30 feet per minute to approximately 32° F. per second when casting a bar of equal cross section at a casting rate of 40 feet per minute and approximately 50° F. per second when casting a bar of equal cross section at a casting rate of 50 feet per minute. The casting bar is then stripped from the casting wheel 10*a* at the temperature of from about 800° F. to about 940° F. and passed to rolling mill 12 where the bar is hot formed and coated with a soluble oil solution with an oil concentration of about 40% and at a temperature below 200° F., usually at about 160° F. Rolling mill 12 includes a plurality of roll stands which compress the cast bar 15 alternatively from top to bottom and side to side, which functions to lengthen the cast bar and reduce the cross sectional area of the cast bar, so that the bar is progressively formed into rod 17. The volume of the soluble oil concentration in rolling mill 12 is maintained at a level of about ⅔ the volume of oil in a continuous casting system for EC rod. The temperature and volume of the coolant applied to the rod in the rolling mill 12 is controlled so that the temperature of the rod is at a level so that the rod is within the hot forming temperature range of 6201 aluminum alloy, which is usually above 650° F., to prevent precipitation of the alloy metals from the aluminum alloy. Generally, the temperature of the rod exiting the hot forming step is at least 700° F. The low volume of cooling applied to the rod in the rolling mill requires the higher concentration of lubricant be present in the coolant solution, at approximately 40% solution of lubricant for the present system as compared to approximately 10% solution of lubricant from an EC rod system, and the flow is adjusted so that an approximately equal flow of coolant solution is provided to each roll stand.

Figure 2:
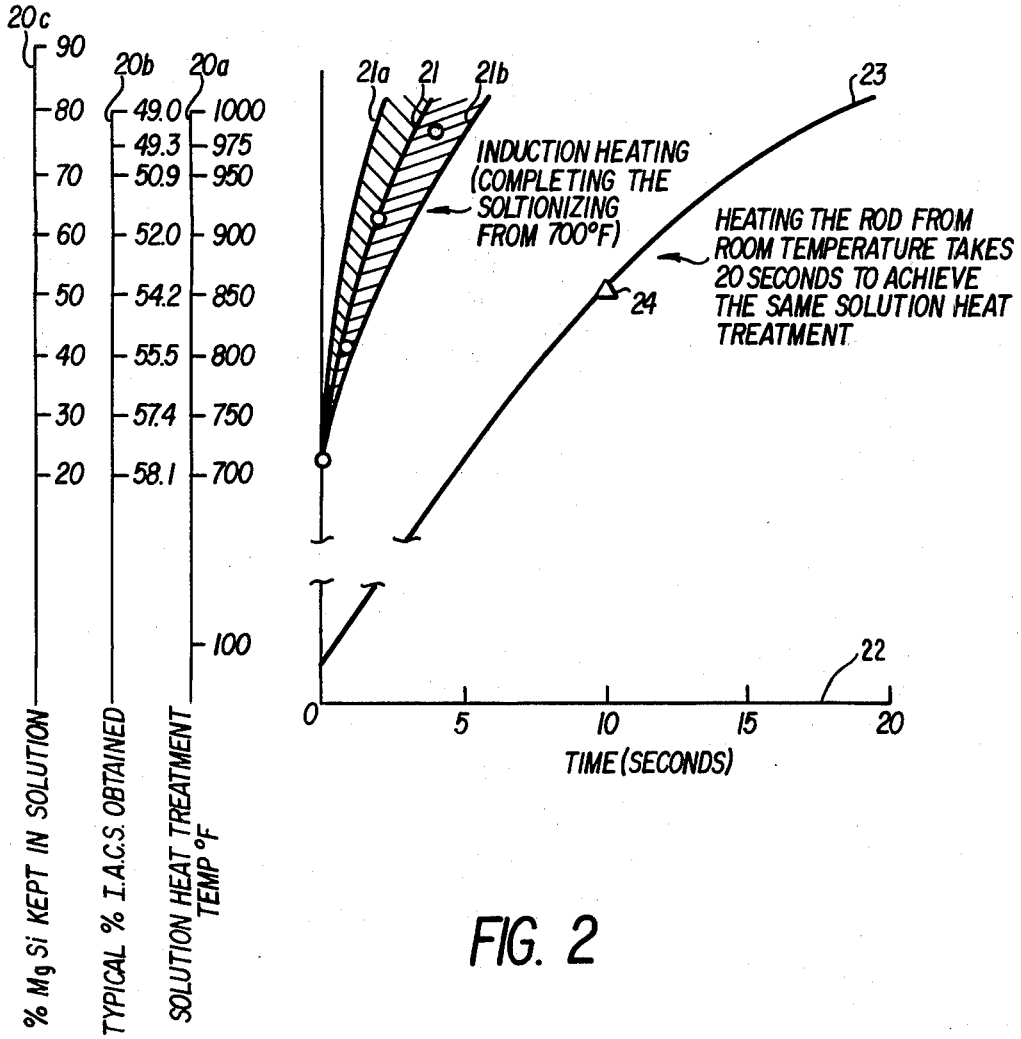
FIG. 2 is a graphical representation of the effect of heat treatment of 6201 aluminum alloy by the present invention compared to prior art methods of preparing 6201 aluminum alloy.

FIG. 2 is a graphical comparison of the differences between 6201 aluminum alloy rod solution heat treated by the method of the present invention and prior art methods. Line 22 of FIG. 2 represents time in seconds.

Line 20*a* represents temperature in degrees farenheit. Line 20*b* represents conductivity as percent of the International Annealed Copper Standard (IACS) and line 20*c* represents percent magnesium silicide $Mg_2Si$ in solution. Line 23 is a plot of 6201 aluminum alloy wrought rod undergoing solution heat treatment by the prior art methods and lines 21, 21*a* and 21*b* represent the solution heat treatment of 6201 aluminum alloy wrought rod by the method of the present invention. FIG. 2 is best understood by considering the following examples which are representative of the data which may be obtained from FIG. 2 which data is representative of the distinct advantages which the method of the present invention has over prior art methods for solution heat treating 6201 aluminum alloy wrought rod.

EXAMPLE I

A wrought rod fabricated from 6201 aluminum alloy by the method of the present invention enters the solution heat treating step at zero (0) time, from lines 22, 21*a* and 21*b* and 21 at a temperature of 700° F., line 20*a* has an electrical conductivity of approximately 58.1 percent IACS, line 20*b* and with line 20*c* approximately 20 percent of the magnesium silicide present in the alloy already in solid solution. A wrought rod of 6201 aluminum alloy fabricated by the prior art method requires approximately 5 seconds of heating by an induction heating to obtain similar characteristics.

EXAMPLE 2

To obtain a 6201 aluminum alloy wrought rod having 60% of the magnesium silicide present in the alloy in solid solution, electrical conductivity of 52.0% IACS a solutionizing temperature of 900° F. requires induction heating of the rod for a period of from about 1 second to about 2.75 seconds, with the average heating time required to obtain these properties being approximately 1.75 seconds. To obtain a rod having the same characteristics using prior art processing methods would require heat treatment time of about 11.66 seconds. Thus it can be seen from the comparison examples 1 and 2 and from the multiplicity of other examples which can be demonstrated by a study of FIG. 2 that the method of the present invention is clearly superior to the prior art methods in terms of processing times. Not only is this method superior to prior art methods in terms of processing efficiency, the properties of the 6201 alloy wrought rod so produced are also superior to the properties of 6201 alloy rod produced by prior art methods. Exemplary of these superior properties of 6201 alloy rod produced by the present invention are the following:

(1) The cast bar may be removed from the casting wheel at a lower temperature and consequently high temperature cracking, piping and central microcracking of the cast bar is substantially reduced thereby producing a better quality wrought rod.

(2) Rod produced by the method of the present invention is in a highly annealed state and consequently is easier to draw into wire.

(3) Precipitation of magnesium silicide occurs during artificial aging of the wire drawn from the wire which results in a more finely divided and more evenly distributed precipitate.

(4) Rod produced by prior art methods not drawn within about 6 days of casting and rolling becomes brittle. However, rod produced by the method of the present invention has been stored from 7 to 8 weeks before being drawn into wire without becoming brittle.

While this invention has been described in detail with particular reference to preferred embodiments thereof, it will be understood that variations and modifications can be effected within the spirit and scope of the invention as described hereinbefore and as defined in the appended claims.

What is claimed is:

1. A method of continuously casting and rolling a heat treatable hot formed aluminum base alloy product comprising: casting a molten aluminum base alloy metal in a continuous casting mold; cooling said molten aluminum base alloy metal during casting to form a cast bar at a temperature above that temperature at which the alloying metals present in said aluminum base alloy metal would precipitate to the grain boundaries of said aluminum base alloy metal and at a rate at which solidification shrinkage will not occur; continuously removing said cast bar from said continuous casting mold and passing said cast bar to a hot rolling mill wherein said cast bar is hot formed into a wrought rod; initiating the step of hot forming the cast bar while the cast bar is at a temperature within the hot forming temperature range of the metal and which temperature is a solutionizing temperature of the metal, continuing the hot forming step while maintaining the temperature of the cast bar within the hot forming temperature range; immediately after the hot forming step and before any substantial cooling of the wrought rod, continuously passing the wrought rod to an in-line heater for approximately five seconds or less wherein the temperature of said wrought rod is raised to a temperature which is a solutionizing temperature of the metal and maintaining the temperature of the wrought rod for a time sufficient to solution heat treat said wrought rod and reducing the temperature of the wrought rod after the solution heat treating step at a rate so as to reduce the temperature of the wrought rod from the solutionizing temperature to a temperature at which no substantial immediate precipitation of alloying metal occurs.

2. A method of continuously casting an aluminum base alloy rod containing from about 0.5 to about 0.9 weight percent silicon, about 0.6 to about 0.9 weight percent magnesium and the remainder essentially aluminum comprising the steps of:

(a) pouring a molten aluminum base alloy containing from about 0.5 to about 0.9 weight percent silicon, about 0.6 to about 0.9 weight percent magnesium and the remainder essentially aluminum into the casting groove of a continuous casting wheel at a temperature above the melting point of the aluminum base alloy;

(b) cooling the molten aluminum base alloy in the casting groove to form a cast bar at a rate at which solidification shrinkage will not occur;

(c) removing the cast bar from the casting groove at a temperature below 940° F.;

(d) continuously hot forming the cast aluminum base metal at a temperature within the hot forming range to form a rod;

(e) immediately after the hot forming step and before any substantial cooling of the rod, continuously passing the rod through an in-line heater for approximately five seconds or less to raise the temperature of the rod to a temperature above the temperature at which the alloying metals will precipitate to the grain boundaries of the aluminum base metal; and (f) continuously quenching the rod to a temperature below the temperature level at which immediate substantial precipitation of the alloying metals occur.

3. The method of claim 2 wherein the molten aluminum base alloy is cooled to a temperature of from about 800° F. to about 940° F. in the casting groove.

4. The method of claim 2 wherein the temperature of the rod after passing through the heater is from about 700° F. to about 1050° F.

5. The method of claim 2 wherein the temperature of the rod after passing through the heater is from about 700° F. to about 800° F.

6. The method of claim 2 wherein the temperature of the rod after passing through the heater is from about 800° F. to about 1050° F.

7. The method of claim 2 wherein the temperature of the cast bar entering the hot forming step is from about 800° F. to about 1050° F.

8. The method of claim 2 wherein the temperature of the cast bar entering the hot forming step is from about 700° F. to about 940° F.

9. The method of claim 2 wherein the temperature of the rod exiting the hot forming step is at least 700° F.

10. The method of claim 3 wherein the step of continuously hot forming the cast metal to form a rod at a temperature above the temperature level at which the alloying metals precipitate to the grain boundaries of the aluminum base metal comprises hot rolling the aluminum alloy bar while coating a soluble oil on the bar as it is rolled, said soluble oil being at a temperature of less than 200° F.

11. The method of claim 3 wherein the step of continuously quenching the rod to a temperature below the temperature level at which immediate substantial precipitation of the alloying metals would occur, and completing the cooling of the alloy aluminum metal from the beginning of the hot forming step to the end of the quenching step within the time interval before which any substantial precipitation of the alloying metals occurs, comprises, quenching the hot rolled rod immediately after it exits the heater to a temperature of less than 400° F.

12. The method of claim 2 wherein the temperature of the cast bar after passing through the heater is from about 700° F. to about 850° F.

13. The method of claim 2 wherein the temperature of the cast bar after passing through the heater is from about 850° F. to about 950° F.

14. The method of claim 2 wherein the temperature of the cast bar after passing through the heater is from about 950° F. to 1050° F.

15. The method of claim 2 wherein the temperature of the cast bar entering the hot forming step is from about 850° F. to about 950° F.

16. The method of claim 2 wherein the temperature of the cast bar entering the hot forming step is from about 950° F. to about 1050° F.

* * * * *